US010704267B1

(12) United States Patent
Scott et al.

(10) Patent No.: US 10,704,267 B1
(45) Date of Patent: Jul. 7, 2020

(54) ONE LEG FLOORBOARD

(71) Applicant: G-CON Manufacturing, Inc., College Station, TX (US)

(72) Inventors: Jason K. Scott, Katy, TX (US); Garrett A. Bond, Bryan, TX (US); Mark P. Taylor, Philadelphia, PA (US); R. Blake Williams, College Station, TX (US)

(73) Assignee: G-CON Manufacturing, Inc., College Station, TX (US)

( * ) Notice: Subject to any disclaimer, the term of this patent is extended or adjusted under 35 U.S.C. 154(b) by 0 days.

(21) Appl. No.: 16/369,198

(22) Filed: Mar. 29, 2019

(51) Int. Cl.
*E04F 15/02* (2006.01)
*E04F 15/06* (2006.01)

(52) U.S. Cl.
CPC ..... *E04F 15/02038* (2013.01); *E04F 15/06* (2013.01); *E04F 2201/023* (2013.01)

(58) Field of Classification Search
CPC ..... E04F 15/02038; E04F 15/06; E04F 2201/023
See application file for complete search history.

(56) References Cited

U.S. PATENT DOCUMENTS 1,913,342 A * 6/1933 Schaffert ..... E04D 3/30 52/588.1
3,100,556 A * 8/1963 De Ridder ..... F16B 5/008 52/588.1
3,269,072 A * 8/1966 Black ..... B61D 17/10 52/377
3,983,668 A 10/1976 Hassamn
4,266,385 A * 5/1981 Oehlert ..... E04D 3/362 52/521
4,951,992 A * 8/1990 Hockney ..... B62D 25/2054 105/422
5,185,193 A * 2/1993 Phenicie ..... B65D 90/026 220/1.5
5,527,128 A * 6/1996 Rope ..... E01C 5/20 404/35
5,758,467 A * 6/1998 Snear ..... E04C 2/20 52/177
5,782,044 A * 7/1998 Dodd ..... E04F 19/10 345/629
5,816,010 A * 10/1998 Conn ..... E04C 2/08 52/588.1
6,536,178 B1 3/2003 Palsson et al.
6,601,359 B2 8/2003 Olofsson
6,619,002 B2 * 9/2003 Pettit ..... E01C 5/223 114/267

(Continued)

*Primary Examiner* — Paola Agudelo
(74) *Attorney, Agent, or Firm* — Kilpatrick Townsend & Stockton LLP

(57) ABSTRACT

Extruded floorboards having integrated standoffs, or legs, to offset them from the ground or floor underneath, are disclosed in which adjacent floorboards share a common leg for standing off. On each side of the cross section of a floorboard, a shorter leg mates with a longer leg of an adjacent floorboard through a tongue & groove. The mated legs are supported by the longer leg and a foot at the bottom of the longer leg. A stiffening rib is included. The longer leg is longer than the shorter leg and stiffening rig by a predetermined distance so as to leave clearance for air bearings or other components underneath an assembled floor.

13 Claims, 7 Drawing Sheets

(56) References Cited

U.S. PATENT DOCUMENTS

| | | | | |
|---|---|---|---|---|
| 7,047,697 | B1 * | 5/2006 | Heath | E04F 15/10 52/177 |
| 7,264,305 | B2 * | 9/2007 | Kuriakose | B62D 25/2054 296/193.07 |
| 7,726,088 | B2 | 6/2010 | Muehlebach | |
| 7,841,145 | B2 | 11/2010 | Pervan et al. | |
| 7,908,815 | B2 | 3/2011 | Pervan et al. | |
| 8,359,794 | B2 * | 1/2013 | Biro | E04F 13/0736 52/177 |
| 8,550,401 | B2 | 10/2013 | Lieven et al. | |
| 9,347,226 | B2 * | 5/2016 | Ouellet | E04F 15/02016 |
| 9,765,980 | B2 | 9/2017 | Holtz et al. | |
| 2011/0020589 | A1 * | 1/2011 | Kan | B62D 25/2054 428/83 |
| 2018/0010344 | A1 * | 1/2018 | McClure | E04F 15/06 |

* cited by examiner

ONE LEG FLOORBOARD

CROSS-REFERENCES TO RELATED APPLICATIONS

Not Applicable

STATEMENT AS TO RIGHTS TO INVENTIONS MADE UNDER FEDERALLY SPONSORED RESEARCH AND DEVELOPMENT

Not Applicable

BACKGROUND

1. Field of the Invention

Embodiments of the present invention generally relate to sheetlike elements assembled parallel to an existing floor and spaced therefrom, and more specifically to extruded metal floorboards with integrated long and short legs that space the floorboards from the walls.

2. Description of the Related Art

U.S. Pat. No. 9,765,980, issued to Holtz et al., discloses a modular, self-contained, mobile clean room. About the size of a modular building, it is able to be transported by semitrailer, railcar, or cargo aircraft. Unlike non-modular buildings, such clean rooms often employ lightweight construction, modular facilities can use aluminum frames with steel and aluminum panels, both inside and out. They often lack drywall that is porous and can be drilled into and re-filled.

Multiple such clean rooms can be set together in warehouses or other gray space buildings. The building provides electricity, chilled and hot water, HVAC (heating ventilation, and air conditioning), clean gases, drainage hookups, and communications wiring. Besides their use as analysis laboratories, the mobile clean rooms are a relatively quick way to support the manufacture of biopharmaceutical bulk biologics. Some clean rooms are certifiable to Class 10,000 air purity.

The modular clean rooms are large, having their own dedicated maintenance rooms at one end in which the utilities are monitored and/or filtered. Ductwork, plumbing, pressurized gas pipes, and electrical conduit runs from the maintenance rooms through the walls, above the ceiling, and underneath the floors to where they are needed within the clean room area.

Housed inside the clean rooms are often heavy, often bulky, laboratory and manufacturing equipment. For example, a clean room may contain a centrifuge, tissue culture hood, chemical handling unit, stirrer tank, chromatography column, cell sorter, bioreactor, refrigerator, freezer, incubator, biosafety cabinet, temperature cycler, vacuum, or freeze dryer. Some equipment within the clean rooms is on heavy duty casters so that it may be repositioned to a new station or otherwise transported by rolling on the floor. Moving the entire modular clean room is another matter.

Air bearings that can lift the modular clean room on a warehouse floor are set at its four corners and edges. The air bearings are each about 45 centimeters (cm) (18 inches) in diameter and under 6.2 cm (2.4375 inches) tall. There is very little room to install them under the clean rooms, as space underneath the floors is at a premium.

There is a need in the art for improved flooring in modular clean rooms that is less expensive, lighter, and offers more room for components within the floors.

BRIEF SUMMARY

Generally, metal floorboards having a constant cross section capable of being extruded are described in which the floorboards have integrated standoff spacers from the floor below, the standoff spacers herein referred to as "legs." Adjoining floorboards share a common spacer or leg. The long leg of each floorboard is the shared one, while a shorter leg notches into the neighboring floorboard by way of a tongue & groove support. The floorboards also include a stiffening rib that is short enough to allow room for an air bearing or other components underneath the floor.

Some embodiments of the present invention are related to an extruded floorboard apparatus. The apparatus includes an extruded metal body having a cross section perpendicular to a longitudinal length, the cross section including a horizontal floor section having a flat top, a stiffening rib extending vertically from a central portion of the horizontal floor section, a long leg extending perpendicularly downward from a first end of the horizontal floor section, the long leg having a height and terminating in a foot, a short leg extending perpendicularly downward from a second end of the horizontal floor section, the short leg being shorter than the long leg, and a tongue protruding from one of the legs and a U-shaped groove of uniform wall thickness formed in the other of the legs, wherein the tongue and groove are configured such that when a tongue and a groove of adjacent extruded metal bodies are mated with each other, the short leg of one metal body intimately follows but only partially extends downward along a surface of a long leg of an adjacent metal body, such that the mated short and long legs terminate in the foot of the long leg.

The short leg can have a height that is approximately one half the height of the long leg. The long leg can extend vertically at least 7.6 cm (3.0 inches) more than any other feature under the floorboard, including the stiffening rib, thereby forming an empty cavity below the floorboard.

The entire cross section can have a uniform wall thickness, except for a tee formed by the stiffening rib extending from the horizontal floor section and formed by the tongue protruding from one of the legs. The uniform wall thickness can be 0.64 centimeters (0.25 inches).

The maximum diagonal dimension of the cross section can be less than 27.94 centimeters (11 inches). The extruded metal body can be referred to as a first metal body, and the assembly can include a second metal body mated with and welded to the first metal body. The foot can be L-shaped or T-shaped. If L-shaped, the foot can be turned inward.

The tongue can be on the short leg, and the groove can be on the long leg. The flat top can have a width of 24.13 centimeters (cm) (9.50 inches), the short leg can have a height of 6.5 cm (2.5625 inches), and the long leg can have a height of 12.7 cm (5.0 inches). The floorboard apparatus can have a longitudinal length of 349 centimeters (137.5 inches). The cross section can be unchanging along the longitudinal length. The metal can be aluminum.

A modular building can have floorboards in accordance with claim 1.

DETAILED DESCRIPTION

Heavy duty metal floorboards that themselves are not overly heavy for their purpose are described. They can be extruded with relatively common metal extrusion manufacturing equipment and welded together to form a planar floor. To save weight, they may be manufactured from aluminum. Stiffeners and other features do not need to be cut out as part of the process to integrate air bearings under the floor, although the spacer legs may require torch cutting.

Figure 1:
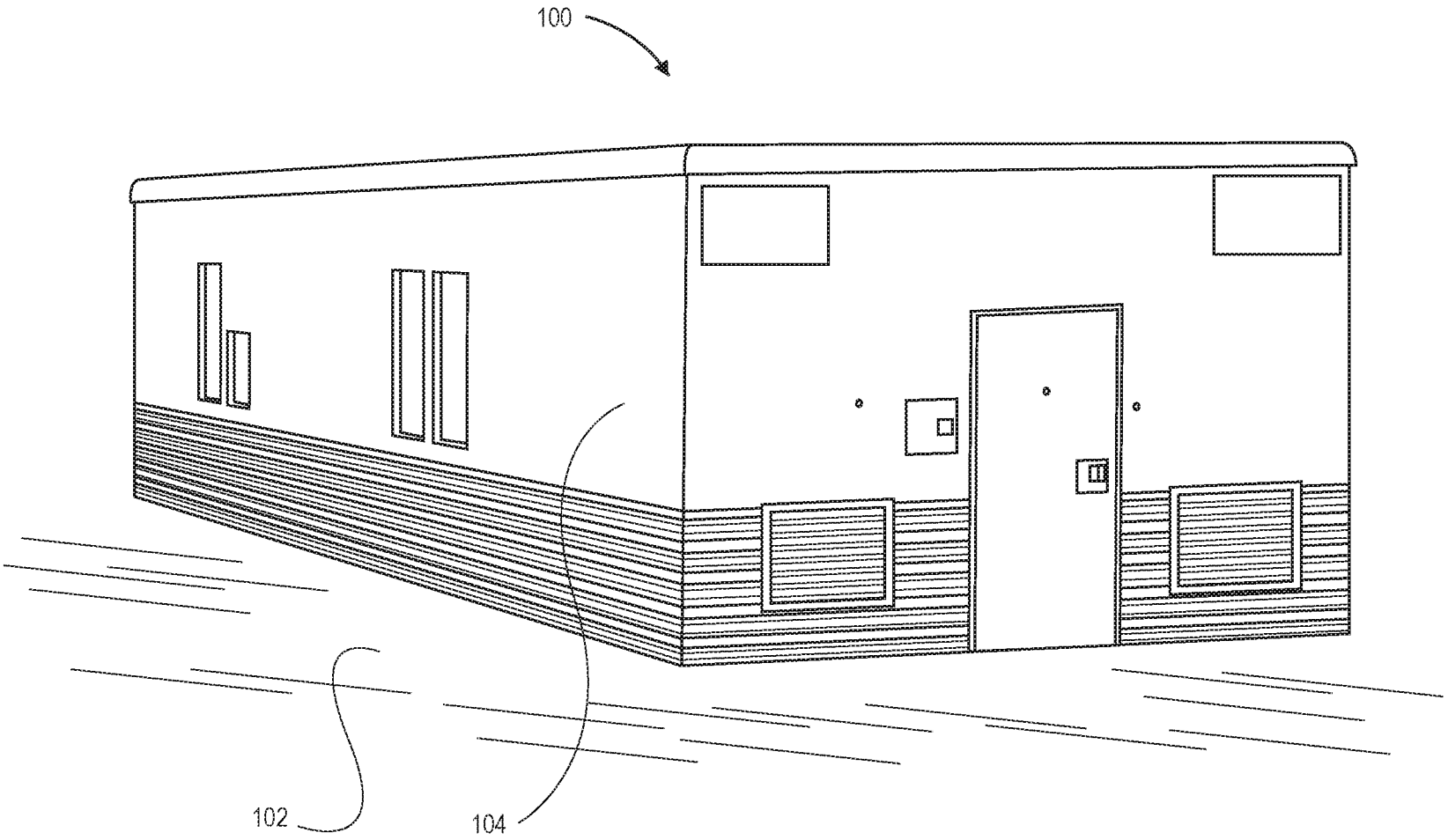
FIG. 1 is a perspective view of a modular clean room employing floorboards in accordance with an embodiment.

FIG. 1 is a perspective view of a modular clean room employing such floorboards inside. Modular clean rooms often are supplied electrical power, chilled and hot water, HVAC, and other utilities through a maintenance room in one end.

In system 100, modular clean room 104 rests on flat concrete floor 102. A power cord extends from a cable tray suspended from the ceiling and plugs into an input socket on the side of the modular clean room. HVAC ductwork extends from the roof of mobile clean room 104 to ductwork in the gray space, supplying fresh air or expelling used air from inside the clean room.

Figure 2:
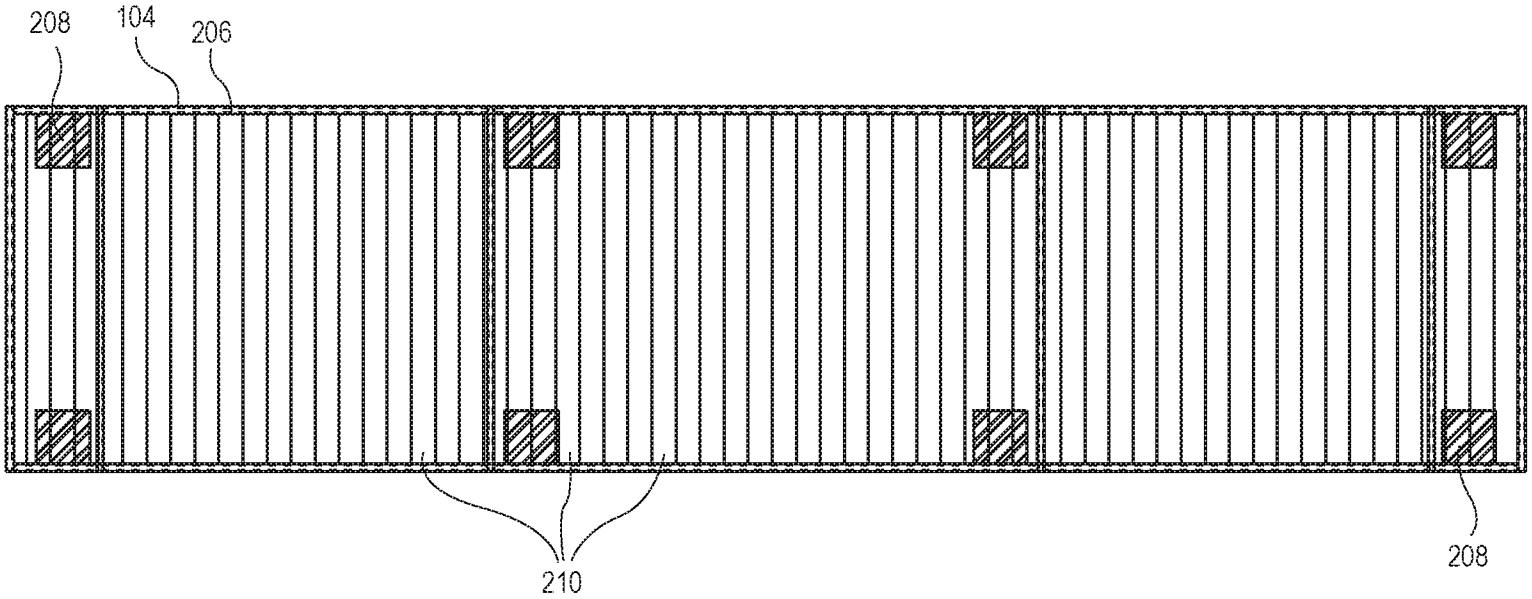
FIG. 2 is a top view of flooring within a modular clean room in accordance with an embodiment.

FIG. 2 is a top view of flooring within modular clean room 104. Walls 206 enclose a 366 cm (12 foot) wide perimeter, which is underlaid with floorboards 210. The floorboards are laid laterally within the structure. They are about 349 cm (137.5 inches) long so that they fit within the rim joists.

Air bearings 208 are positioned in corners and along the sides of the bottom of modular clean room 104, filling in cutouts in the floorboards. The amount of metal that needs to be cut out of the extruded floorboards for the cutouts is minimal, given the air bearings' dimensions.

Figure 3A:
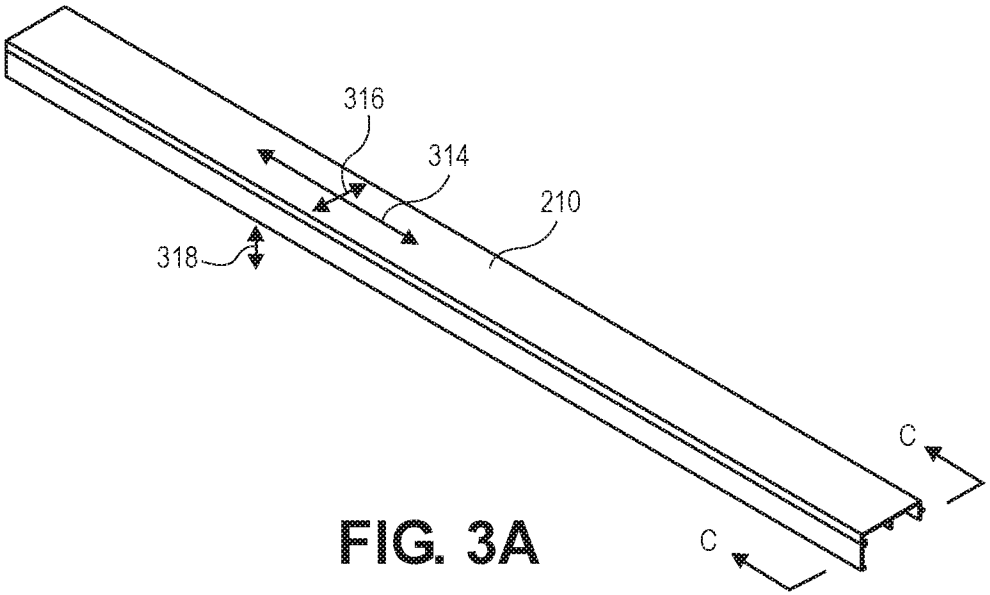
FIG. 3A is an oblique view of a floorboard in accordance with an embodiment.
Figure 3B:
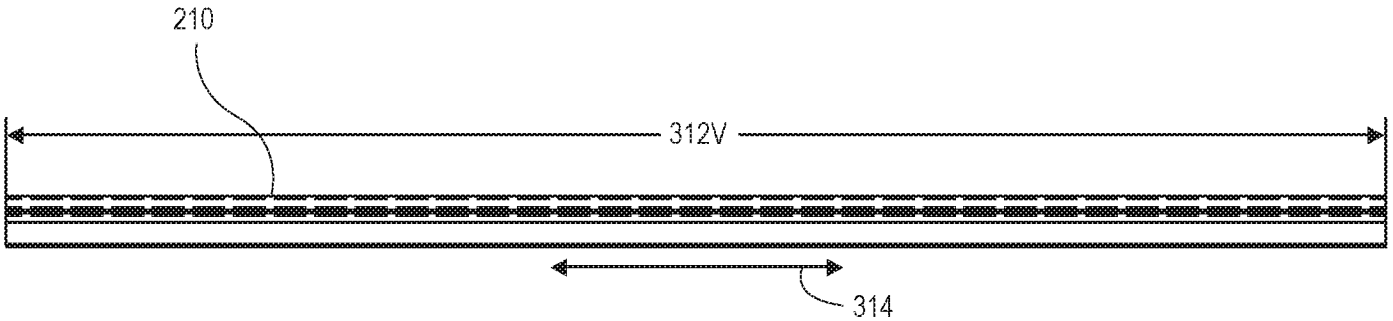
FIG. 3B is a bottom view of the floorboard of FIG. 3A.
Figure 3C:
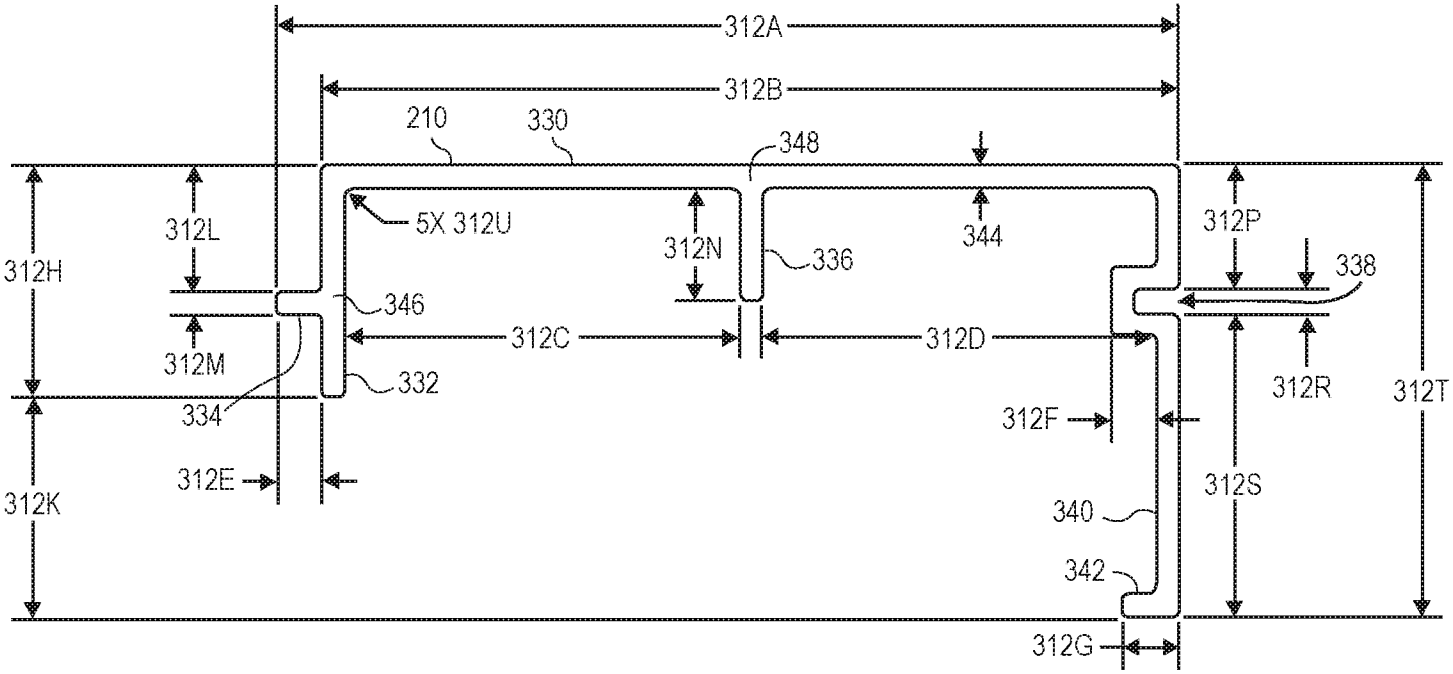
FIG. 3C is a cross section of the floorboard of FIG. 3A.
Figure 3D:
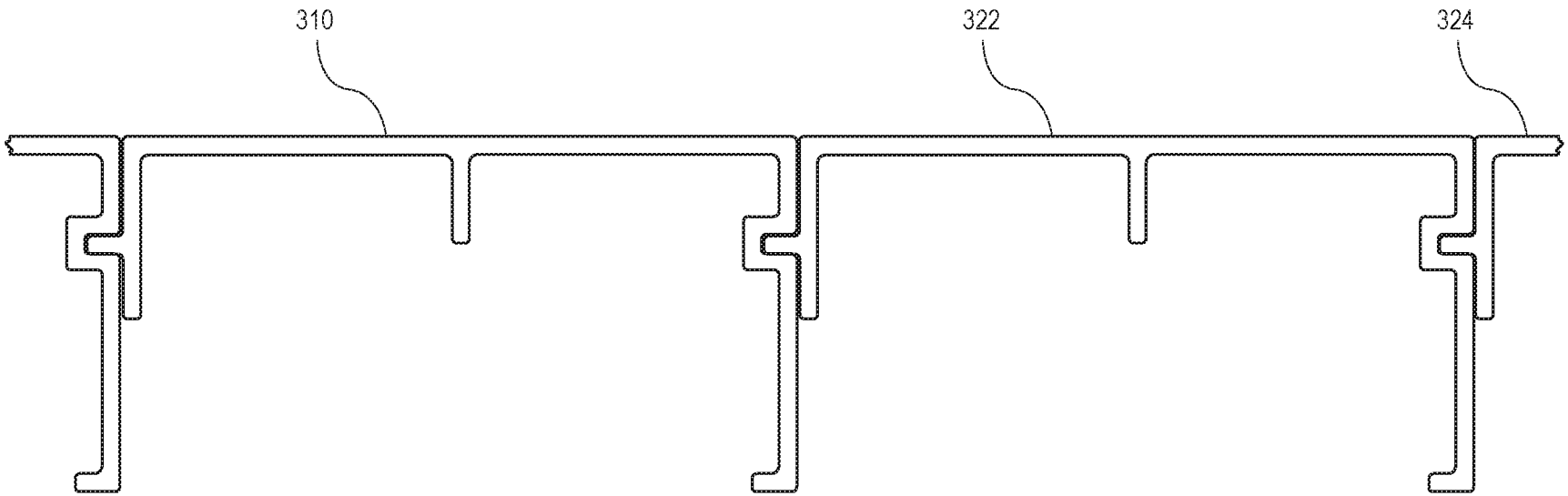
FIG. 3D shows cross sections of mated floorboards in accordance with an embodiment.

FIGS. 3A-3C show a single floorboard metal body 210 in different views, while FIG. 3D shows floorboard metal body 310 mated with adjacent floorboard bodies.

FIG. 3A shows floorboard 210 with longitudinal direction 314, lateral direction 316, and height direction 318. Longitudinal direction 314 is in the direction of the longest dimension of the floorboard, while lateral direction and height direction are orthogonal to it and each other.

FIG. 3B shows floorboard 210 with some features along its length scored during the extrusion process, leaving an otherwise constant cross section body of metal.

FIG. 3C shows a cross section of the metal body of floorboard 210, including notable features that assist in securing, stiffening, and spacing the floorboard from its underlying surface. As seen in the cross section, horizontal floor section 330 has a flat top and two ends, one on the left and one on the right of the page.

Short leg 332 is on one end and extends downward from horizontal floor section 330. Short leg 332 supports tongue 334, the combination of which forms tee section 346. Tongue 334 protrudes outward and perpendicularly from short leg 332.

Long leg 340 is on the opposite end of horizontal floor section 330 from the short leg and also extends downward from horizontal floor section 330. Long leg 340 terminates at the bottom with an L-shaped foot 342, which turns inward toward. Within long leg 340 is shaped a serpentine, U-shaped region of constant wall thickness, which forms groove 338. Groove 338 is at the same height as tongue 334 such that a tongue from one floorboard can mate with a groove from an adjacent floorboard.

FIG. 3D shows floorboards 310, 322, and 324 mated with their neighbors using the tongue & groove features of each floorboard. Two mated legs terminate in one foot—the foot of the longer leg.

When the tongues and grooves of adjacent floorboards are mated with each other, the surfaces of their respective short and long legs intimately follow one another to a large extent, bearing against each other. The short leg, being shorter than the long leg, extends only partially over the surface of the long leg. The long leg continues down to its foot. By virtue of the short leg interlocking with the long leg, the pair of mated legs forms a single spacer that terminates in the foot of the long leg.

As shown in FIG. 3C, stiffening rib 336 extends vertically downward from a central portion of horizontal floor section 330 forming a tee 348 at the intersection.

Except for tee 346 formed by tongue 334 and short leg 332, and tee 348 formed by horizontal floor section 330 and stiffening rib 336, the body of floorboard 210 maintains a constant wall thickness 244.

Dimensions that have been demonstrated to yield good working prototypes are in Table 1.

TABLE 1

| Reference Identifier of Dimension in FIGS. 3A-3C | Dimension (centimeters) | Dimension (inches) |
|---|---|---|
| 312A | 25.4 | 10.00 |
| 312B | 24.1 | 9.50 |
| 312C | 11.1 | 4.375 |
| 312D | 11.1 | 4.375 |
| 312E | 1.3 | 0.50 |
| 312F | 1.3 | 0.50 |
| 312G | 1.59 | 0.625 |
| 312H | 6.51 | 2.5625 |
| 312K | 6.19 | 2.4375 |
| 312L | 3.53 | 1.390625 |
| 312M | 0.64 | 0.25 |
| 312N | 3.18 | 1.25 |
| 312P | 3.49 | 1.3750 |
| 312R | 0.71 | 0.28125 |
| 312S | 8.48 | 3.34 |
| 312T | 12.7 | 5.00 |
| 312U | R = 0.318 | R = 0.125 |
| 312V | 349 | 137.50 |
| 344 | 0.64 | 0.25 |

All tolerances are to those of Aluminum Association Standard Tolerances unless specified otherwise.

Figure 4:
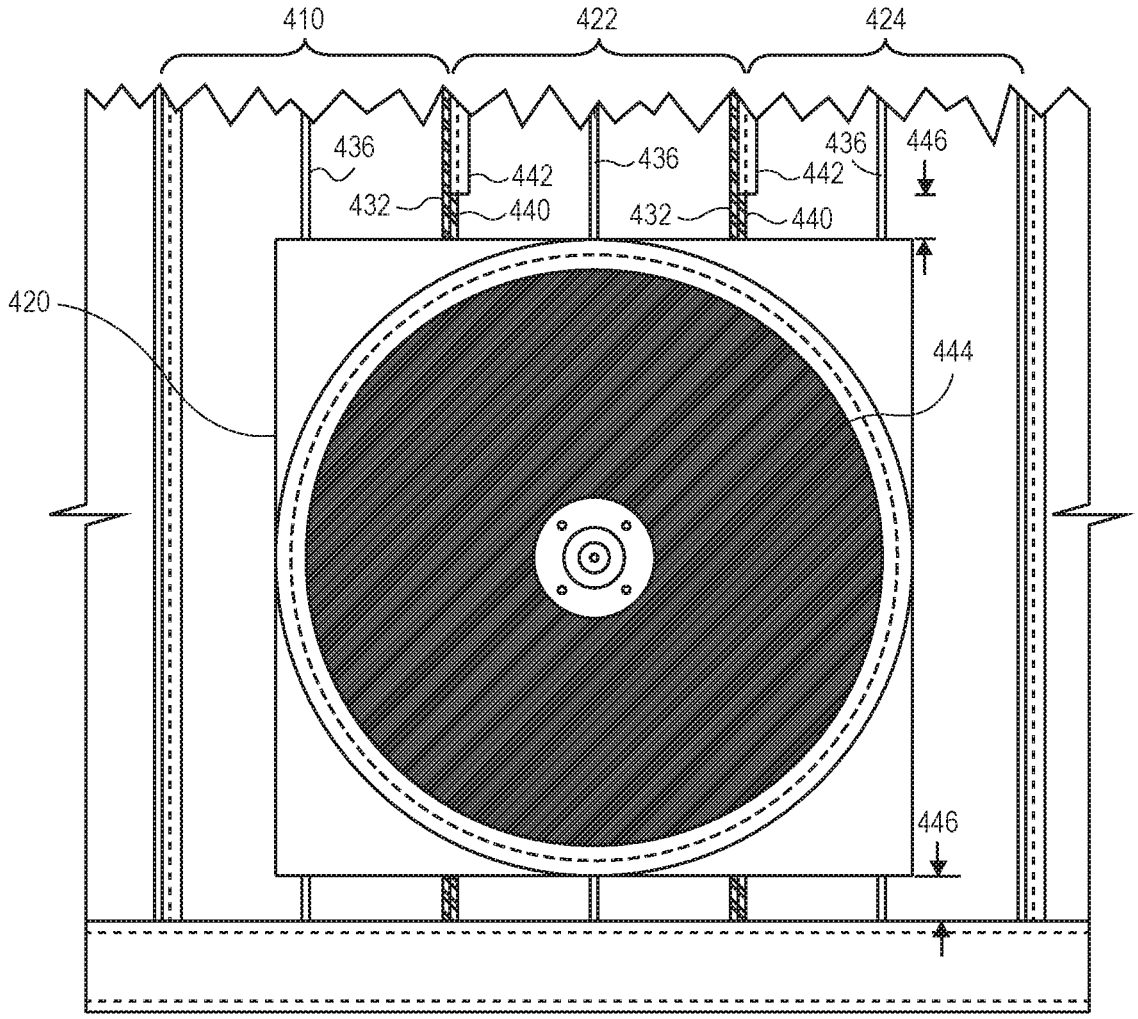
FIG. 4 is a bottom view of an air bearing installed within floorboards in accordance with an embodiment.

FIG. 4 shows a close up of the bottom of air bearing 420 installed within floorboards. Air bearing diaphragm 444 is shown centered among three adjacent floorboards 410, 422, and 424 that have been welded together. A portion of long legs 440, with feet 442, are torch cut from the adjacent floorboards to leave an empty area.

In some embodiments, the bottom of tee 346 (FIG. 3C) of a short leg 432 is cut off so that tongue 334 (FIG. 3C) forms an L-shaped foot. This foot can rest on top of air bearing 420 casing. Otherwise, the short leg 432 can be cut elsewhere, or not cut at all, so that the butt end of the cut short leg simply rests against, or stays above and out of the way of, the air bearing casing. In the exemplary embodiment of the figure, short leg 432 is not cut at all.

In some embodiments, part of the U-shaped channel forming groove 338 (FIG. 3C) is cut off so that the upper portion of the groove channel forms an L-shaped foot. This foot can bear on the top of the air bearing. Otherwise, the long leg 440 can be cut elsewhere so that another part of the channel or vertical rests against, or stays above and out of the way of, the air bearing casing.

The cuts are made so that once air bearing 420 is installed, there are horizontal gaps 430 of about 3.8 cm (1.5 inches) surrounding air bearing 420.

Stiffening ribs 436 do not need to be cut at all. This is because long leg 440 is taller than stiffening ribs 436 by 7.6 to 8.9 cm (3.0 to 3.5 inches), leaving an empty cavity below the horizontal floor and stiffening ribs 436. The empty cavity has enough height to accept the air bearing casing.

Likewise, short legs 432 may not need to be cut at all. Long legs 440 are taller than short legs 432 by 6.19 cm (2.4375 inches), leaving an empty cavity below the horizontal floor, stiffening ribs 436 and short legs 432.

Although the long legs require cutting to fit the air bearing, a technical advantage with the present embodiment is that the required cutting is less than for symmetric floorboards with two long legs. With two long legs, much more metal needs to be cut away, and the thickness of two legs put together is much harder to torch cut. If the short legs are short enough with respect to the long legs, then the short legs may not need cutting at all. The stiffening ribs do not need cutting. This saves touchwork, time, and effort in manufacturing the floor.

Figure 5:
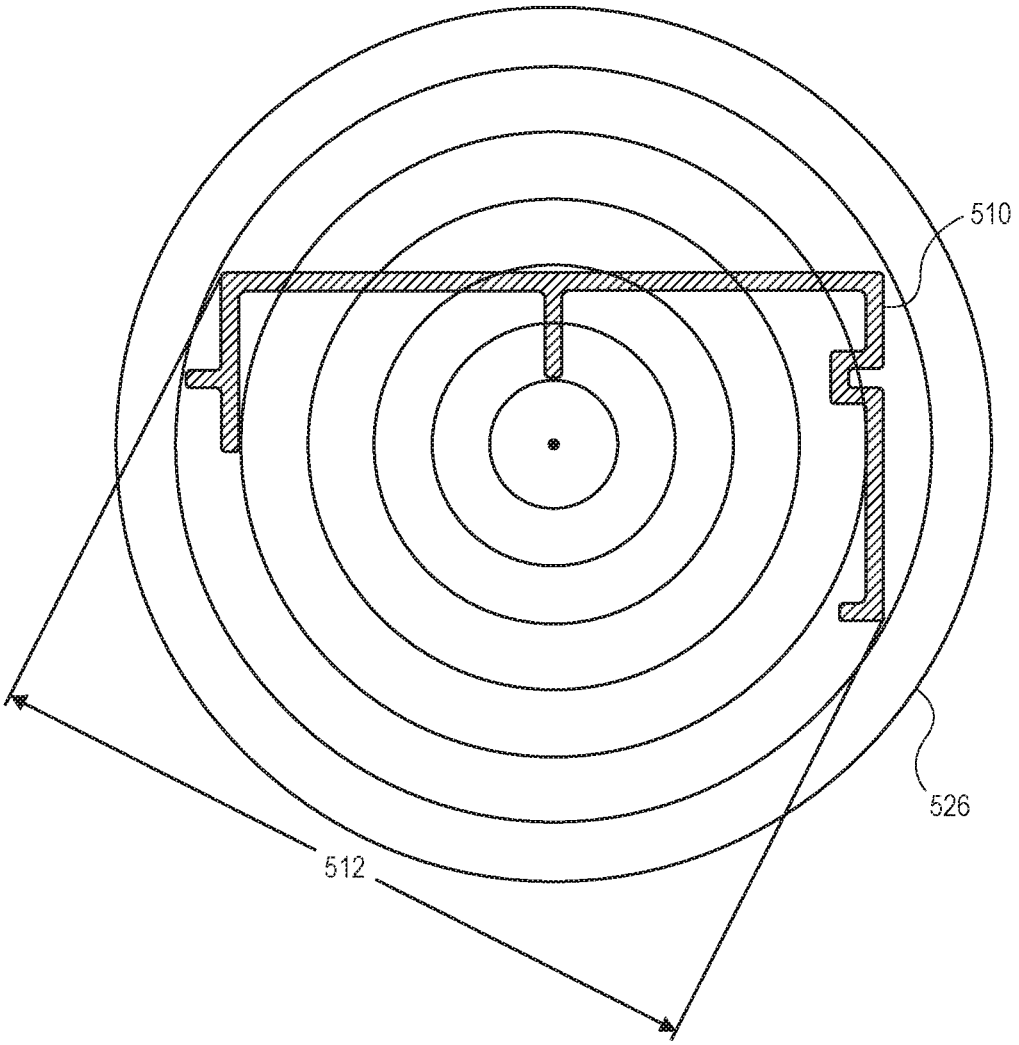
FIG. 5 is a cross section of a floorboard in accordance with an embodiment overlaid on extrusion die plate markers.

FIG. 5 is a cross section of floorboard 510, with maximum diagonal extent 512, overlaid on extrusion die plate markers 526. With a width of 24 cm (9.5 inches), not counting the tongue that sticks out partway down, and height of 12.7 cm (5 inches), the maximum diagonal is just under 27.9 cm (11 inches).

This allows a 27.9 cm (11 inch) or 30.5 cm (12 inch) die plate to be used instead of larger sizes. Larger sized die plates and larger machines are naturally more expensive to use, so smaller die plates are desirable.

Extruding hundreds, or thousands, of identical floorboards and then drilling holes and cutting out only certain portions of long legs helps make the manufacturing process of mobile clean rooms more efficient. There is less waste of metal and less material to purchase for the flooring.

The terms "horizontal" and "vertical" denote an orientation in the floorboard's normal mode of operation and do not limit the particular elements to particular orientations with respect to gravity. The terms are used for convenience. A horizontal and vertical element are generally perpendicular with one another.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. An extruded floorboard apparatus comprising:

an extruded metal body having a cross section perpendicular to a longitudinal length, the cross section including:

a horizontal floor section having a flat top;

a stiffening rib extending vertically from a central portion of the horizontal floor section;

a long leg extending perpendicularly downward from a first end of the horizontal floor section, the long leg having a height and terminating in a foot;

a short leg extending perpendicularly downward from a second end of the horizontal floor section, the short leg being shorter than the long leg; and a tongue protruding from one of the legs and forming a tee below the flat top and a U-shaped groove of uniform wall thickness formed in the other of the legs, a portion below the tee or U-shaped groove on the short leg configured to be cut off while preserving said tongue or groove, wherein the tongue and groove are configured such that when a tongue and a groove of adjacent extruded metal bodies are mated with each other, the short leg of one extruded metal body intimately follows but only partially extends downward along a surface of a long leg of an adjacent metal body, such that the mated short and long legs terminate in the foot of the long leg, wherein the long leg extends vertically down at least 7.6 cm (3.0 inches) more than the tongue, the groove, and the stiffening rib.

2. The apparatus of claim 1 wherein the short leg has a height that is approximately one half the height of the long leg.

3. The apparatus of claim 1 wherein the entire cross section has a uniform wall thickness, except for a tee formed by the stiffening rib extending from the horizontal floor section and the tee formed by the tongue protruding from one of the legs.

4. The apparatus of claim 3 wherein the uniform wall thickness is 0.64 centimeters (0.25 inches).

5. The apparatus of claim 1 wherein a maximum diagonal dimension of the cross section is less than 27.9 centimeters (11 inches).

6. The apparatus of claim 1 wherein the extruded metal body is a first metal body, the apparatus further comprising:

a second metal body mated with and welded to the first metal body.

7. The apparatus of claim 1 wherein the foot is L-shaped and turns inward.

8. The apparatus of claim 1 wherein the tongue is on the short leg, and the groove is on the long leg.

9. The apparatus of claim 1 wherein the flat top has a width of 24.13 centimeters (cm) (9.50 inches), the short leg has a height of 6.5 cm (2.5625 inches), and the long leg has a height of 12.7 cm (5.0 inches).

10. The apparatus of claim 1 wherein the floorboard apparatus has a longitudinal length of 349 centimeters (137.5 inches).

11. The apparatus of claim 1 wherein the cross section is unchanging along the longitudinal length.

12. The apparatus of claim 1 wherein the metal body is comprised of aluminum.

13. A modular building having floorboard apparatuses in accordance with claim 1.

* * * * *